US005131256A

United States Patent [19]

Sofy

[11] Patent Number: 5,131,256

[45] Date of Patent: Jul. 21, 1992

[54] PIVOTING TRANSFER UNIT MOUNT FOR A STAMPING PRESS

[76] Inventor: Hugh M. Sofy, 201 Warrington Dr., Bloomfield Hills, Mich. 48013

[21] Appl. No.: 434,891

[22] Filed: Nov. 9, 1989

[51] Int. Cl.[5] ..... B21D 43/05

[52] U.S. Cl. ..... 72/405; 403/12; 198/621; 198/861.6; 411/412

[58] Field of Search ..... 72/405, 421, 422; 403/343, 12; 414/750, 751; 198/621, 774, 861.6, 861.1; 10/11 T, 12 T, 72 T, 76 T; 411/411-413

[56] References Cited

U.S. PATENT DOCUMENTS

| | | | |
|---|---|---|---|
| 2,929,474 | 3/1960 | Boardman | 411/412 |
| 3,878,042 | 4/1975 | Curulla | 403/12 |
| 4,127,023 | 11/1978 | Jensen | 72/405 |
| 4,139,089 | 2/1979 | Jensen | 198/621 |
| 4,186,364 | 5/1986 | Berger | 72/405 |

FOREIGN PATENT DOCUMENTS

| | | | |
|---|---|---|---|
| 9932 | 1/1986 | Japan | 72/405 |
| 124411 | 6/1986 | Japan | 198/861.1 |
| 1250117 | 10/1971 | United Kingdom | 72/405 |

*Primary Examiner*—Daniel C. Crane

*Attorney, Agent, or Firm*—Reising, Ethington, Barnard, Perry & Milton

[57] ABSTRACT

A stamping press (22, 22') includes an transfer mechanism (24, 24') for moving workpieces through progressive die stations. Two embodiments of a support structure (26, 26') are disclosed for supporting the transfer mechanism (24, 24') adjacent the press (22, 22'). Both embodiments of the support structure (26, 26') include a first screw shaft (34, 34') and a second screw shaft (38, 38') which fasten the transfer mechanism (24, 24') to the press (22, 22') in an operative position. The first screw shaft (34, 34') includes a first locking screw (40, 40') and the second screw shaft (38, 38') includes a second locking screw (54, 54') for retaining the respective first (34, 34') and second (38, 38') screw shaft in an unfastened condition to allow movement of the transfer mechanism (24, 24') from the operative position. A bearing (63, 63') interconnects the transfer mechanism (24, 24') and the stamping press (22, 22') for allowing pivotal movement of the transfer mechanism (24, 24') away from the operative position when at least one of the first (34, 34') and second (38, 38') screw shafts are in the unfastened condition.

49 Claims, 12 Drawing Sheets

26'
B, D
38'
60'
66'
118'
140'
68'
138'
A, C
28'
44'
32'
30'
64'
112'
34a'
50'
48'
49'
46'
42'
40'
34'
36'
E
89
88
86
87
63'
96
22'
108
108
84
142
140
138
112
142
66
110
140
138

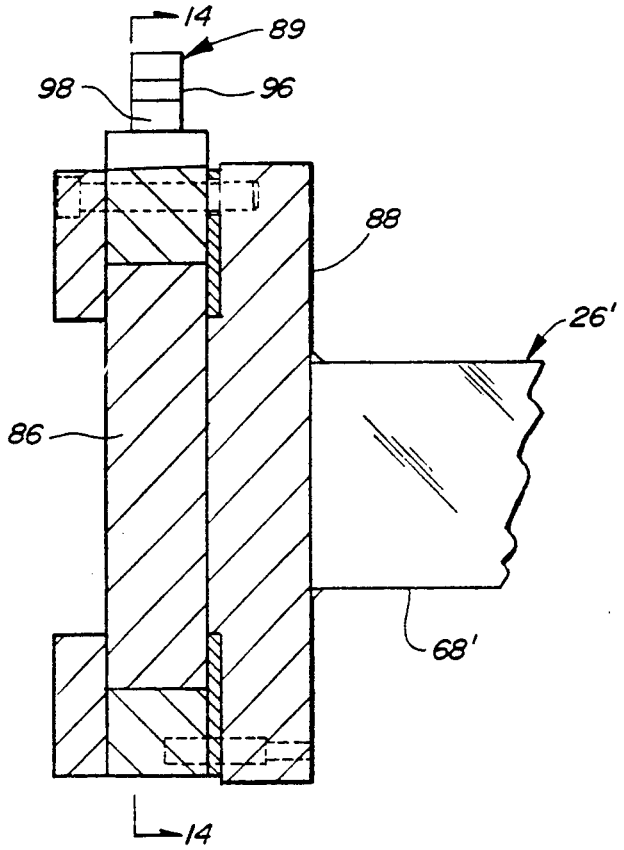
FIG. 13
FIG. 14
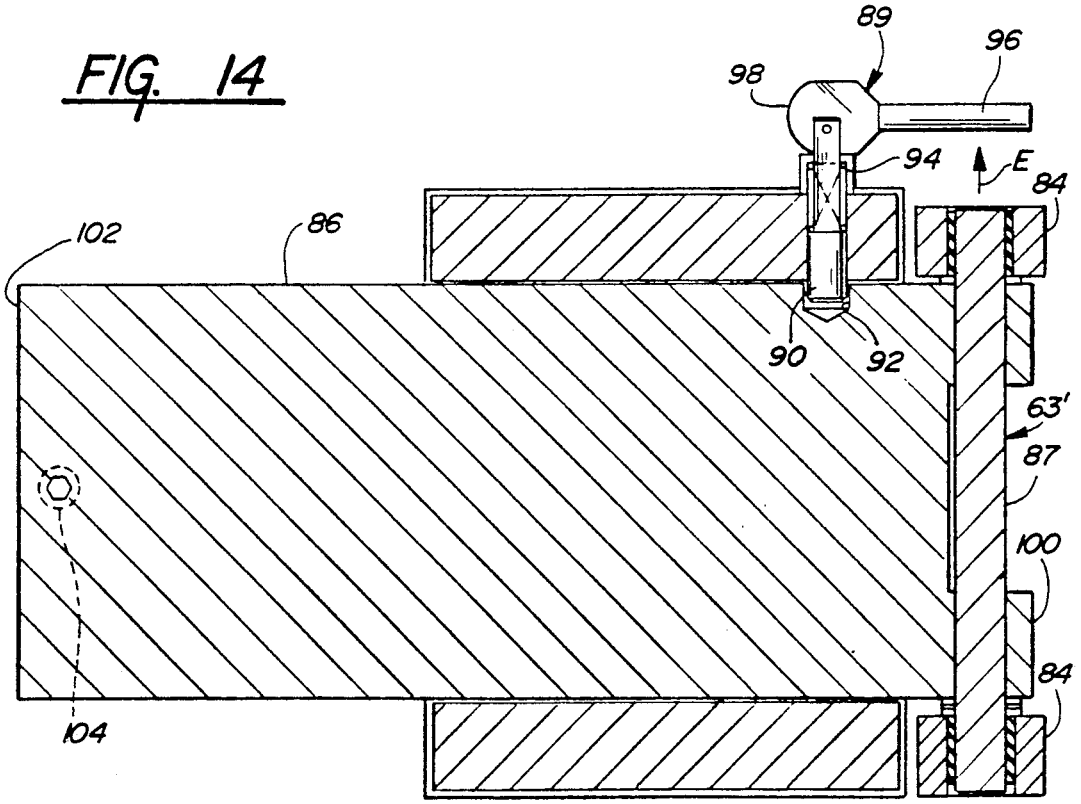

PIVOTING TRANSFER UNIT MOUNT FOR A STAMPING PRESS

TECHNICAL FIELD

The subject invention relates generally to a transfer mechanism support assembly for a progressive die type stamping press, and more particularly to an improved fastening assembly for the transfer mechanism support assembly.

BACKGROUND ART

Punch press machines are frequently used in manufacturing processes to form a sheet metal blank into a final workpart shape. Because of the intricate shape of some workparts, a plurality of successive forming operations must be performed to each workpart before the final desired shape can be achieved.

A transfer mechanism is provided for sequentially moving the workpeices between adjacent die stations. Two such transfer mechanisms are typically employed, with one flanking each side of the stamping press. The transfer mechanisms, however, have the inherent disadvantage of blocking access to the die area. Therefore, whenever access to the dies is required, one or both of the transfer mechanisms must be completely removed from the press.

To eliminate this disadvantage, the prior art teaches supporting the transfer mechanism on a rotatable member to allow arcuate movement of the transfer mechanism away from the die area. At least one screw shaft extends vertically through the transfer mount and threads into a threaded socket in the bolster of the stamping press to fasten the transfer mechanism in an operative position. When it is desired to gain access to the die area by rotating the transfer mechanism from its operative position, the screw shaft is unthreaded and manually supported in a retracted position while the transfer mechanism is moved.

Many transfer mechanisms also provide for lateral adjustment between two or more predetermined operative positions. At least two screw shafts securely fasten the transfer mechanism mount to the bolsters of the press. When the screw shafts are unthreaded to unfasten the transfer mechanism from the press, they are manually held in the retracted position while the transfer mechanism is adjusted to a new operative position.

SUMMARY OF THE INVENTION AND ADVANTAGES

The subject invention contemplates a workpiece transfer apparatus for a progressive die type stamping press. The apparatus comprises indexing means for moving workpieces between adjacent progressive dies, a support means having an operative position adjacent the press for supporting the indexing means, and a fastener means disposed for movement with the force of gravity to an extended position for fastening the support means in the operative position and against the force of gravity to a retracted position for allowing movement of the support means out of the operative position. The invention is characterized by a retainer means for retaining the fastener means in the retracted position against the force of gravity to allow movement of the support means from the operative position.

The retainer means of the subject invention automatically retains the fastener means in the retracted position to eliminate the need for manual retension and hence, to facilitate movement of the support means from the operative position. When the support means is moved from the operative position adjacent the press, the fastener means is moved to the retracted position with the retainer means automatically retaining the fastener means in the retracted position against the force of gravity so that the support means can be easily moved from the operative position.

BRIEF DESCRIPTION OF THE DRAWINGS

Other advantages of the present invention will be readily appreciated as the same becomes better understood by reference to the following detailed description when considered in connection with the accompanying drawings wherein:

FIG. 13 is a fragmentary cross-sectional view of the slide plate and sleeve member as taken along lines 13—13 of FIG. 12;

FIG. 14 is a cross-sectional view taken along lines 14—14 of FIG. 12;

DETAILED DESCRIPTION OF THE EMBODIMENT OF FIGS. 1-9

The embodiment illustrated in FIGS. 1-9 is particularly suited for use in a stamping press machine having a relatively large number of die stations spanning a substantial length.

Referring to the Figures where like numerals indicate like or corresponding parts throughout the several views, a workpiece transfer apparatus is generally shown at 20. The apparatus 20 is mounted adjacent and operated in concert with a progressive die type stamping press, generally indicated at 22 in FIG. 1. The workpiece transfer apparatus 20 includes transfer mechanism, or indexing means, generally indicated at 24, for individually moving workpieces between adjacent progressive dies. The indexing means 24 is typically connected through a mechanical linkage to the reciprocating press ram (not shown) for controlling movements of the indexing means to engage the workpieces, transfer the workpeices, retract from the workpieces, and return to an initial starting position in response to the instantaneous position of the press ram.

A support means is generally indicated at 26 for supporting the indexing means 24. The support means 26 has a predetermined operative position adjacent and parallel to the press for supporting the indexing means 24 in a position to move the workpieces between adjacent progressive dies. The indexing means 24 is fixedly attached to the support means 26 and moveable therewith.

Figure 3:
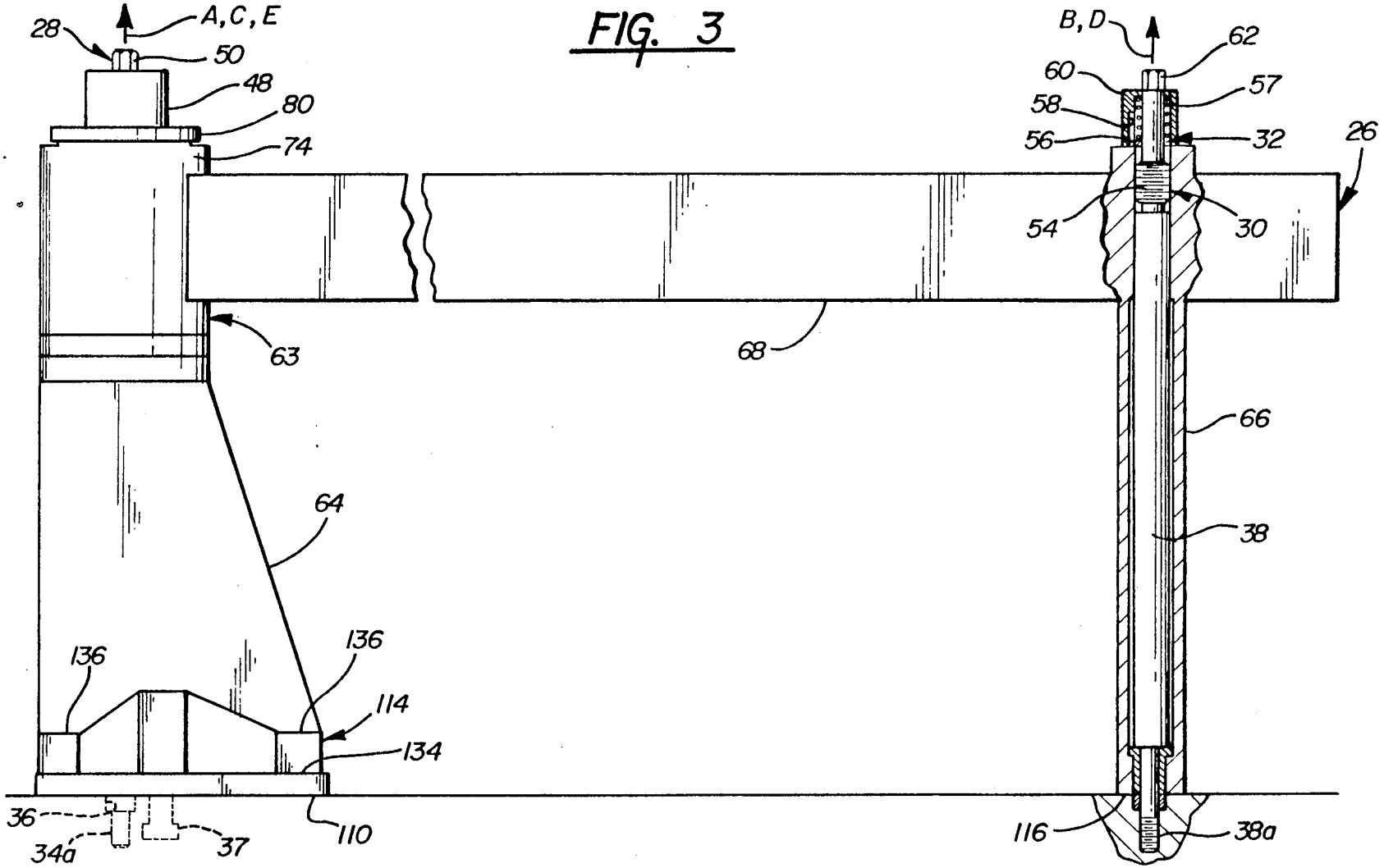
FIG. 3 is a front elevation view of the support means of the subject invention.
Figure 5:
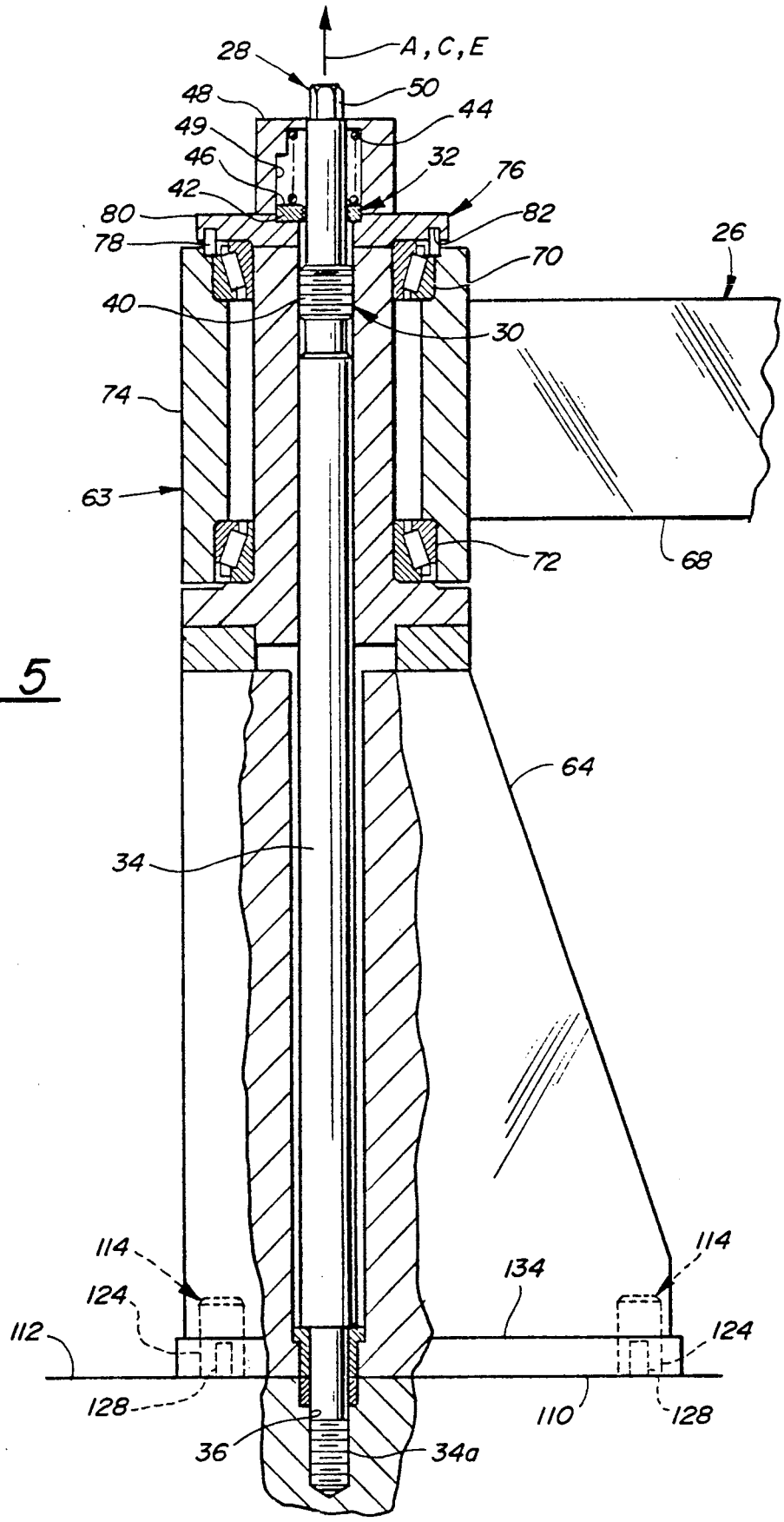
FIG. 5 is a fragmentary front elevation view in partial cross section showing the fastener means in the extended, position.
Figure 6:
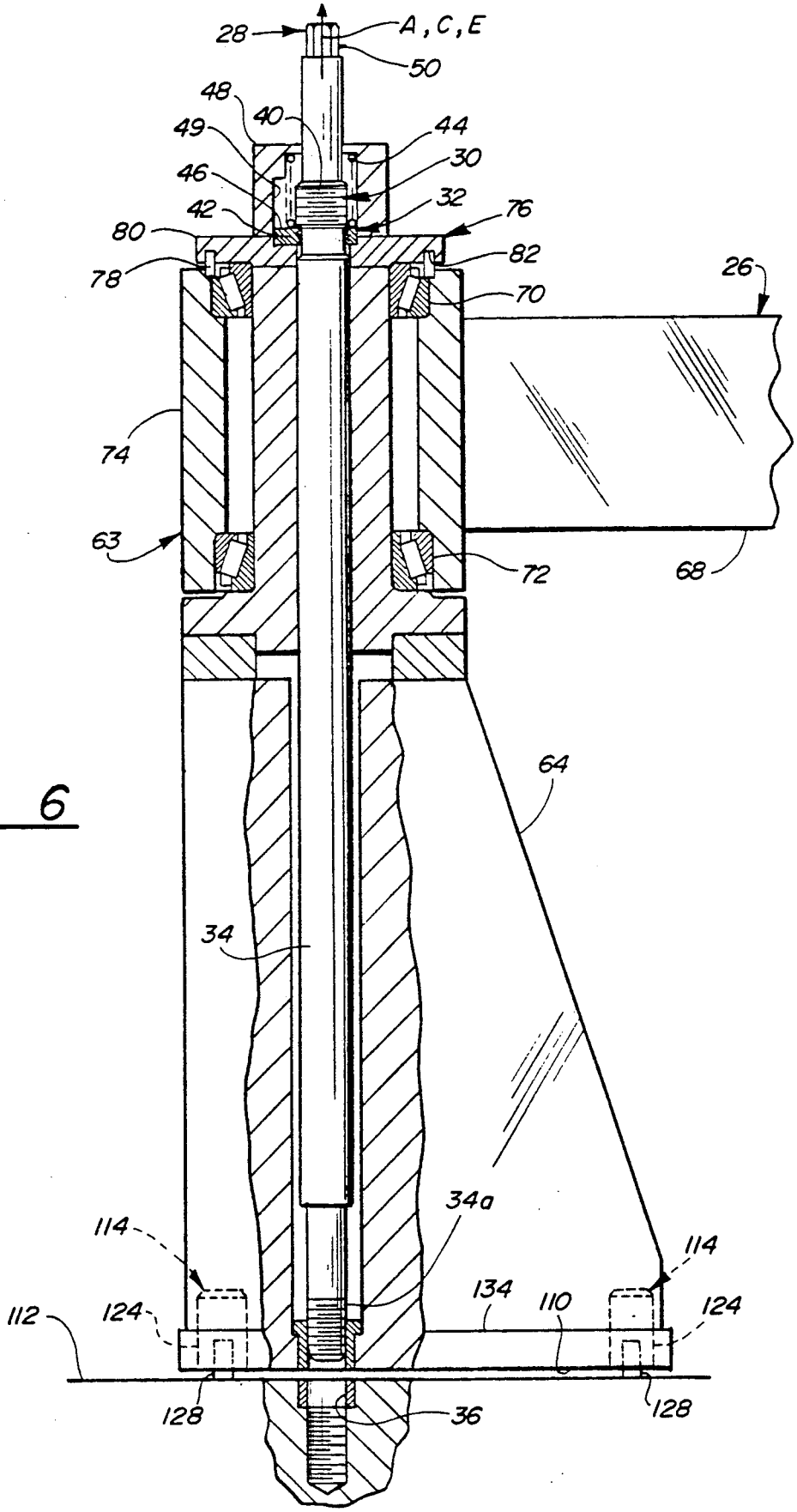
FIG. 6 is a fragmentary front elevation view as in FIG. 5 showing the fastener means in the retracted position.

As best shown in FIGS. 3, 5 and 6, a fastener means, generally indicated at 28, is disposed for movement with the force of gravity to an extended position for fastening the support means 26 in the operative position. The fastener means 28 is shown in the extended position in FIGS. 3 and 5. The fastener means 28 is also disposed for movement against the force of gravity to a retracted position for allowing movement of the support means 26 out of the operative position. The fastener means 28 is shown in the retracted position in FIG. 6. Therefore, when the fastener means 28 is in the extended position, the support means 26 is fixedly attached to the stamping press 22. Alternatively, when the fastener means 28 is in the retracted position, the support means 26 is unattached to the stamping press 22 and free to move from the operative position.

The subject invention is characterized by including a retainer means, generally indicated at 30, for retaining the fastener means 28 in the retracted position against the force of gravity to allow movement of the support means 26 from the operative position. The retainer means 30 includes an automatic locking means, generally indicated at 32 in FIGS. 5–9, for automatically locking the fastener means 28 in the retracted position as the fastener means 28 moves toward the retracted position. In other words, as the fastener means 28 is moved from the extended position to the retracted position, the automatic locking means 32 of the retainer means 30 automatically secures the fastener means 28 in the retracted position against the force of gravity.

As best shown in FIGS. 5 and 6, the fastener means 28 includes a first screw shaft 34 extending along a first screw axis A and having a predetermined screw thread pitch along threads 34*a* for operatively engaging a threaded bore 36 of the press 22. Similarly, the fastener means 28 includes a second screw shaft 38 which is spaced from the first screw shaft 34 and has a second screw axis B which is parallel to the first screw axis A, as shown in FIG. 3. The second screw shaft 38 has a predetermined screw thread pitch along threads 38*a* adapted to engage a threaded bore 39 of the press 22 when in the extended position. A T-bolt 37 is disposed adjacent the first screw shaft 34 as an additional fastening member.

The automatic locking means 32 includes a first locking screw 40 which is associated with the first screw shaft 34 and rotatable about a first lock axis C in response to rotation of the first screw shaft 34 about the first screw axis B. The first locking screw 40 has a screw thread pitch which is equivalent to the screw thread pitch of the first screw shaft 34. A first locking nut 42 is spaced axially from the first locking screw 40 for operatively engaging the first locking screw 40 in response to axial movement of the first screw shaft 34 from the extended position to the retracted position.

As the first screw shaft 34 is moved from the extended to the retracted position by rotation, the first locking screw 40 is caused to rotate at the same angular rate and, with the equivalent thread pitch, is urged to threadably engage the first locking nut 42 in unison with the unthreading of the threads 34*a* from the bore 36. Therefore, the first locking screw 40 is threaded into the first locking nut 42 as the first screw shaft 34 is moved from the extended to the retracted position. In this manner, the first locking nut 42 physically restrains the entire first screw shaft 34 from movement with the force of gravity to hold the first screw shaft 34 in the retracted position as shown in FIG. 9.

A first biasing means 44 is provided for biasing the first locking nut 42 toward the first locking screw 40. The first biasing means 44 is a safety feature which allows the first locking nut 42 to move upwardly as the first locking screw 40 engages the first locking nut 42. When, as illustrated in FIG. 8, the screw threads of the first locking nut 42 and first locking screw 40 do not immediately come into alignment for threadable engagement, the first locking nut 42 is allowed to slide against the biasing of the first biasing means 44 until the proper rotational orientation is achieved between the first locking screw 40 and first locking nut 42 to allow threadable engagement.

The first locking screw 40 is integral with the first screw shaft 34, with the first locking screw 40 being disposed annularly about the first screw shaft 34. Therefore, the first screw axis A and the first lock axis C are coaxial and coincidental.

Figure 7:
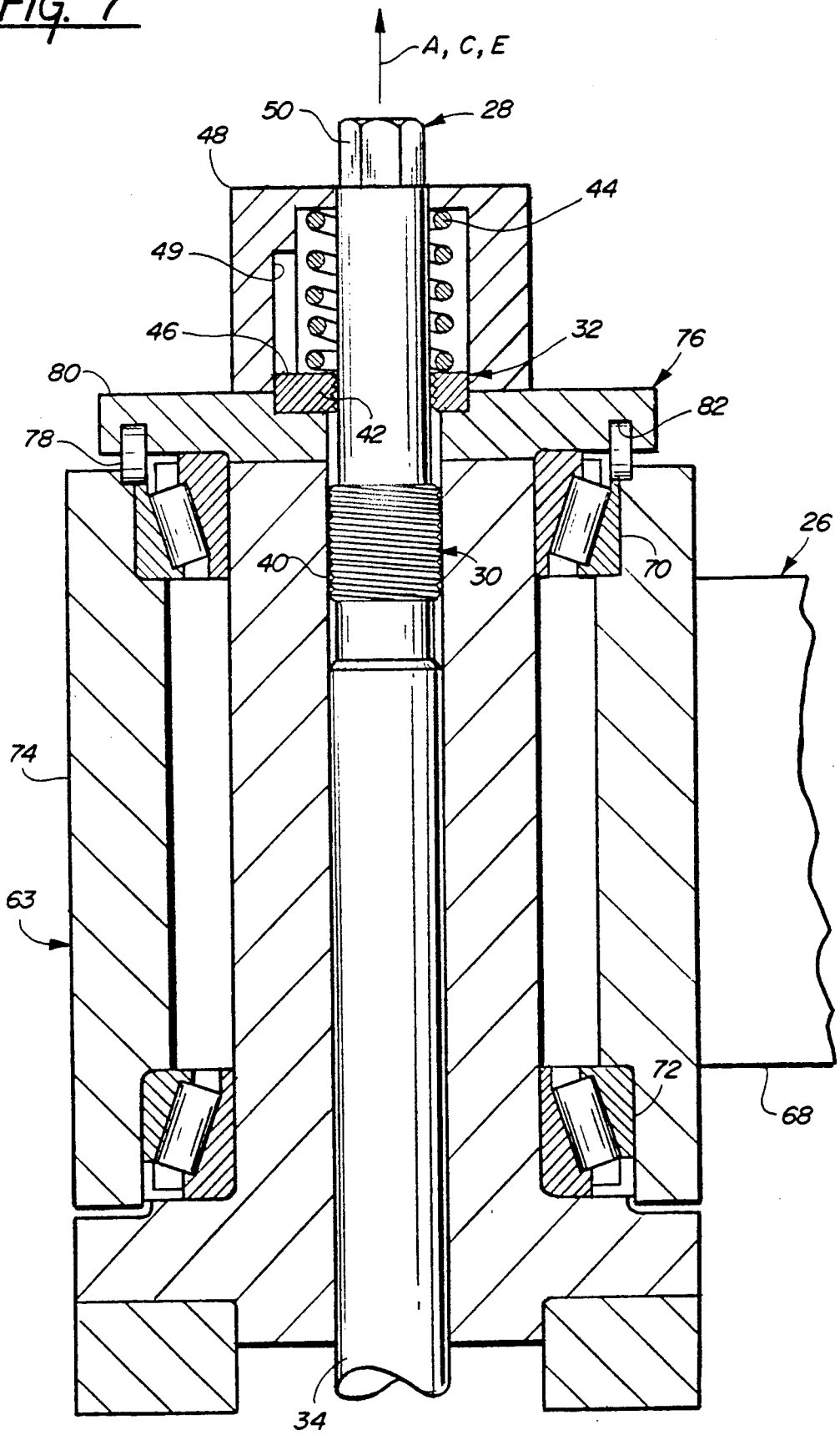
FIG. 7 is an enlarged cross-sectional view of the retainer means of the subject invention.
Figure 9:
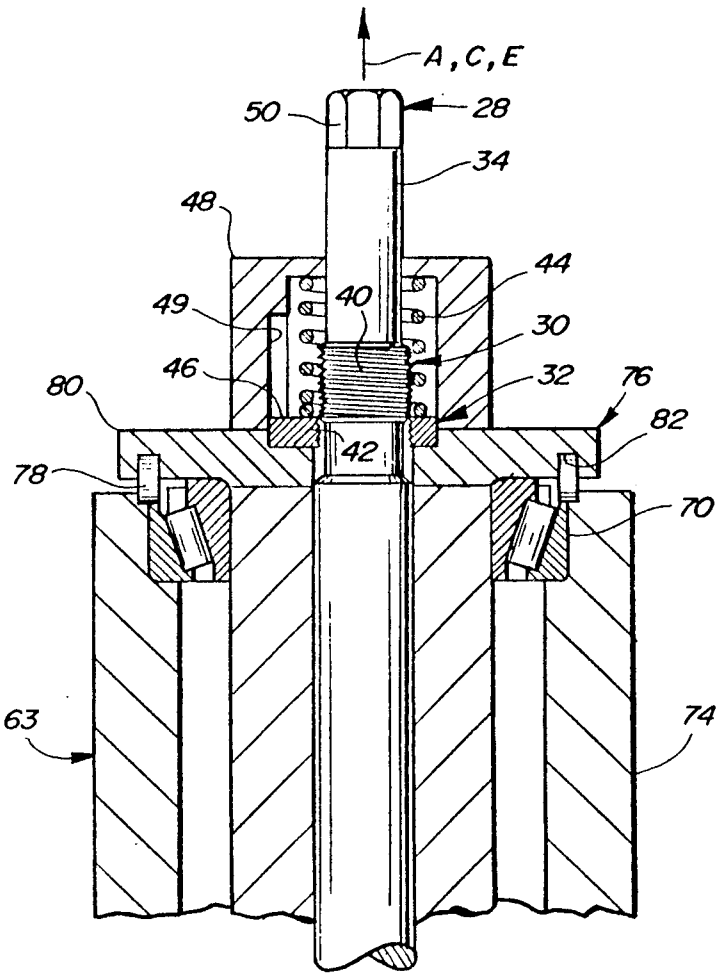
FIG. 9 is a cross-sectional view as in FIG. 8 showing the first locking screw fully engaged above the first locking nut.
Figure 8:
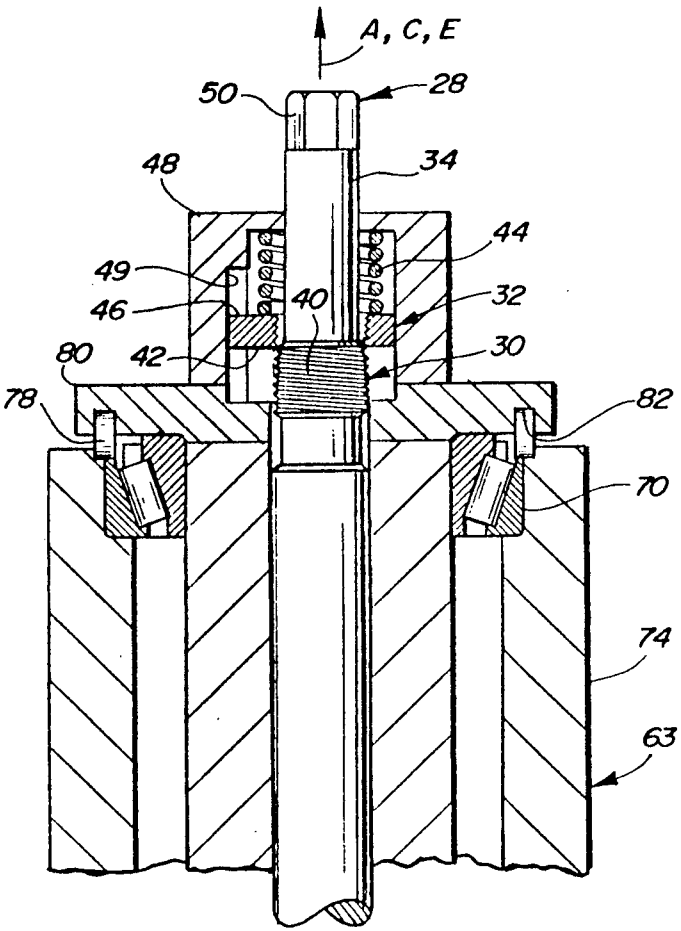
FIG. 8 is a cross-sectional view of the retainer means showing the first locking nut deflected upwardly.

As best shown in FIGS. 7–9, the first locking nut 42 includes an anti-rotation means 46 for preventing rotation of the first locking nut 42 while allowing movement thereof along the first lock axis C as the first biasing means 44 moves against the first biasing means 44. More specifically, a first cover member 48 surrounds the first locking nut 42 and the first biasing means 44. The anti-rotation means 46 generally comprises a tab-like portion and is disposed between the first locking nut 42 and the first cover member 48. An axially extending slot 49 is provided inside the cover member 48 and slideably receives the tab-like anti-rotation means 46. Therefore, if the first locking screw threads 40 do not immediately engage the first locking nut threads 42, the tab-like anti-rotation means 46 will slide within the slot 49 until the threads 40, 42 finally engage.

The first screw shaft 34 extends axially through the first biasing means 44 and through the first cover member 48 to an external terminal end where a tool adapter portion 50 is disposed. The tool adapter portion 50 extends through the first cover member 48 for receiving a tool, e.g. the socket end of a power driven wrench, to rotate the first screw shaft 34 about the screw axis A.

Assuming the fastener means 28 is in the fully extended position as shown in FIG. 5, the operation of the subject retainer means 30 will be addressed presently. A power driven tool is operatively connected to the tool adapter portion 50 and actuated to rotate the first screw shaft 34 about the axis A. This causes the screw threads 34*a* of the first screw shaft 34 to back out of the threaded bore 36.

However, the length of the threads 34*a* is calculated to be greater than the distance between the first locking screw 40 and the first locking nut 42. Therefore, before the threads 34*a* are moved completely out of the bore 36, the first locking screw threads 40 rotate into engagement with the first locking nut 42.

If the first locking screw 40 does not begin threading into the first locking nut 42 upon initial engagement, then the axially upwardly moving first screw shaft 34 will push upwardly on the first locking nut 42 causing the anti-rotation tab 46 to slide upwardly in the associated slot 49 in the first cover member 48 as in FIG. 8.

Ideally, the first locking screw 40 will threadably engage the first locking nut 42 in less than one complete rotation of the first screw shaft 34 after the first locking screw 40 and first locking nut 42 initially engage. Once threadably engaged, the first locking screw 40 will thread through the first locking nut 42 and into the center of the first biasing means 44 as in FIGS. 6 and 9.

When the first screw shaft threads 34*a* disconnect from the bore 36, the interconnected first locking nut 42 and first locking screw 40 will support the first screw shaft 34 in the retracted position. That is, the first locking nut 42 will hold the threads 34*a* of the first screw shaft 34 completely out of the threaded bore 36 thereby eliminating the need for manual support in the retracted position.

Similar to the description in association with the first screw shaft 34, the automatic locking means 32 also includes a second locking screw 54 which is associated with the second screw shaft 38 and rotatable about a second lock axis D in response to rotation of the second screw shaft 38 about the second screw axis B. The second locking screw 54 has a screw thread pitch which is equivalent to the screw thread pitch of the second screw shaft threads 38*a*.

A second locking nut 56 is axially spaced from the second locking screw 54 and resiliently biased toward the second locking screw 54 by a second biasing means 57. The second locking nut 56 operatively engages the second locking screw 54 in response to movement of the second screw shaft 38 from the extended position to the retracted position in a manner similar to the first locking screw 40 mechanism. The second locking screw 54 is integral with the second screw shaft 38, such that the second screw axis B and the second locking axis D are coaxial and coincidental.

The second locking nut 56 also includes a tab-like anti-rotation means 58 for preventing rotation of the second locking nut 56 while allowing movement thereof along the second locking axis D. A second cover member 60 surrounds the second locking nut 56, with the anti-rotation means 58 being disposed between the second locking nut 56 and the second cover member 60. The interrelationship between the second cover member 60, the second locking nut 56 and the second biasing means 57 is identical to that described above in connection with the first screw shaft 34.

The second screw shaft 38 includes a tool adapter portion 62 which extends through the second cover member 60 for receiving a tool to rotate the second screw shaft 38 about the second screw axis B. Preferably, the tool adapter portion 62 is a hexagonally shaped member presented to receive the socket portion of a power-driven wrench.

As best shown in FIGS. 1-6, the support means 26 includes a rotation means, generally indicated at 63, for fixed attachment relative to the press 22 for rotating the indexing means 24 about a rotary axis E to and from the operative position. That is, the rotation means 63 allows the support means 26 to move in an arcuate path away from the operative position to provide access to the die stations of the stamping press 22. The rotary axis E is preferably parallel to the first screw axis A, and in the embodiment illustrated in FIGS. 1-9, the first screw axis A and rotary axis E are coaxial and coincidental.

As best shown in FIG. 3, the support means 26 includes a first stanchion 64 surrounding the first screw shaft 34, and a second stanchion 66 surrounding the second screw shaft 38. An elongate transfer tube 68 extends perpendicularly of the first A and second B screw axes to interconnect the second stanchion 66 to the rotation means 63. The transfer tube 68 is disposed contiguous the indexing means 24 to provide a horizontal support surface therefor. The transfer tube 68 and the second stanchion 66 are fixedly connected for movement in unison away from the operative position. On the other hand, the transfer tube 68 and the first stanchion 64 are interconnected via the rotation means 63, with the first stanchion 64 being capable of remaining stationary while the transfer tube 68 moves from the operative position.

The rotation means 63, as best shown in FIG. 7, includes an upper roller bearing 70 disposed annularly about the first screw shaft 34 and between the first stanchion 64 and the transfer tube 68. Similarly, a lower roller bearing 72 is axially spaced from the upper roller bearing 70 and disposed between the first stanchion 64 and the transfer tube 68. A cylindrically tubular member 74 is fixedly attached to the transfer tube 68 and disposed for rotation about the first stanchion 64. The upper 70 and lower 72 roller bearings extend from the outer surface of the first stanchion 64 to the inner surface of the tubular member 74 to rotatably interconnect the first stanchion 64 and the transfer tube 68.

A protector means 76, shown in FIGS. 5-9, is disposed over the rotation means 63 for protecting the rotation means 63 from dirt contamination. The protector means 76 includes an annular wall 78 disposed circumferentially about the upper roller bearing 70. The annular wall 78 is fixedly attached to and extends upwardly from the cylindrically tubular member 74 for movement with the transfer tube 68. A disk member 80 extends radially outwardly from the first screw shaft 34 and has an annular groove 82 therein matingly receiving the annular wall 78 to form an annular labyrinth. The disk 80 is fixed to the first stanchion 64 so that as the transfer tube 68 rotates about the rotary axis E.

DETAILED DESCRIPTION OF THE ALTERNATIVE EMBODIMENT OF FIGS. 7-11

The alternative embodiment illustrated in FIG. 7-11 is distinguished from the workpiece transfer apparatus illustrated in FIGS. 1-9, by laterally spacing apart the first screw axis A' and the rotary axis E' while maintaining them parallel. Prime designations are used hereafter to indicate corresponding parts between the two embodiments. More specifically, the support means 26' includes a first stanchion 64' surrounding a first screw shaft 34' and a second stanchion 66' surrounding a second screw shaft 38'. An elongated transfer tube 68' interconnects the first stanchion 64' and the second stanchion 66' with the rotation means 63'. The transfer tube 68' is fixedly attached to both of the first 64' and second 66' stanchions for movement in unison from the operative position.

A rotation means 63' includes a mounting plate 84 for fixed attachment to the press 22'. An elongated slide plate 86 is pivotally connected to the mounting plate 84 about a rotary axis E' by a hinge member 87. As shown in FIGS. 10, 12, 13 and 14, a sleeve member 88 is fixedly attached to the transfer tube 68' and disposed around the slide plate 86 for relative sliding movement therebetween to allow lateral movement of the support means 26' relative to the rotary axis E'.

A securing means, generally indicated at 89 in FIG. 14, secures the sleeve member 88 to the slide plate 86 to prevent relative sliding movement therebetween. The securing means 89 includes a plunger 90 extending through the sleeve member 88 to engage a recess 92 in the slide plate 86. A return means 94 is associated with the plunger 90 for biasing the plunger 90 toward the slide plate 86. A key 96 is pivotally attached to the plunger 90 and has a camming surface 98 adapted to urge the plunger 90 against the return means 94 upon arcuate movement of the key 96. As the key 96 is rotated, the camming surface 98 acts upon the plunger 90 to remove the plunger 90 from the recess 92 in the slide plate 86, and hence allow movement of the sleeve member 88 along the slide plate 86.

The slide plate 86 extends between a pivotal end 100 adjacent the rotary axis E' and a distal end 102. The slide plate 86 includes a stop means 104 adjacent the distal end 82 for limiting movement of the sleeve member 88 therepast. The stop means 104 comprises a screw threadably engaged in the slide plate 86 and having a head portion presented to about the sleeve member 88.

The slide plate 86 has a generally rectangular cross section as taken through a plane passing parallel to the rotary axis E', as shown in FIG. 13. The sleeve member 88 has a correspondingly shaped inner periphery which is generally C-shaped to tightly surround the slide plate 86.

The cylindrical hinge member 87 extends along the rotary axis E' and interconnects the slide plate 86 and the mounting plate 84. Therefore, the transfer tube 68' is connected to the slide plate 86 via the sleeve member 88, and the slide plate 86 is connected to the mounting plate 84 via the hinge member 87. The mounting plate 84 includes a plurality of bolts 108 which extend therethrough for attachment to the press 22', as shown in FIGS. 10 and 11.

Figure 10:
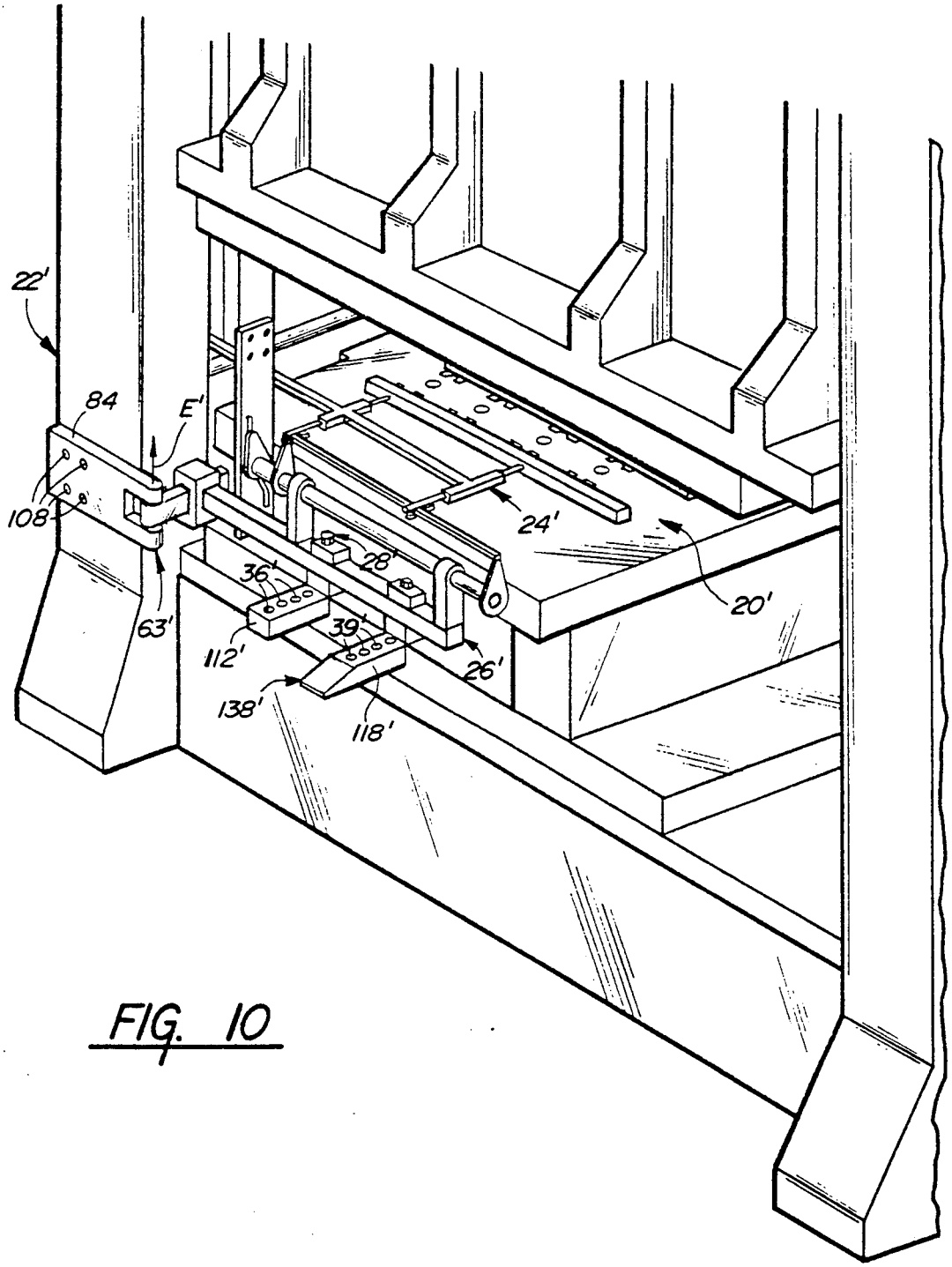
FIG. 10 is a perspective view of an alternative embodiment of the support means according to the subject invention.
Figures 11, 16, 17:
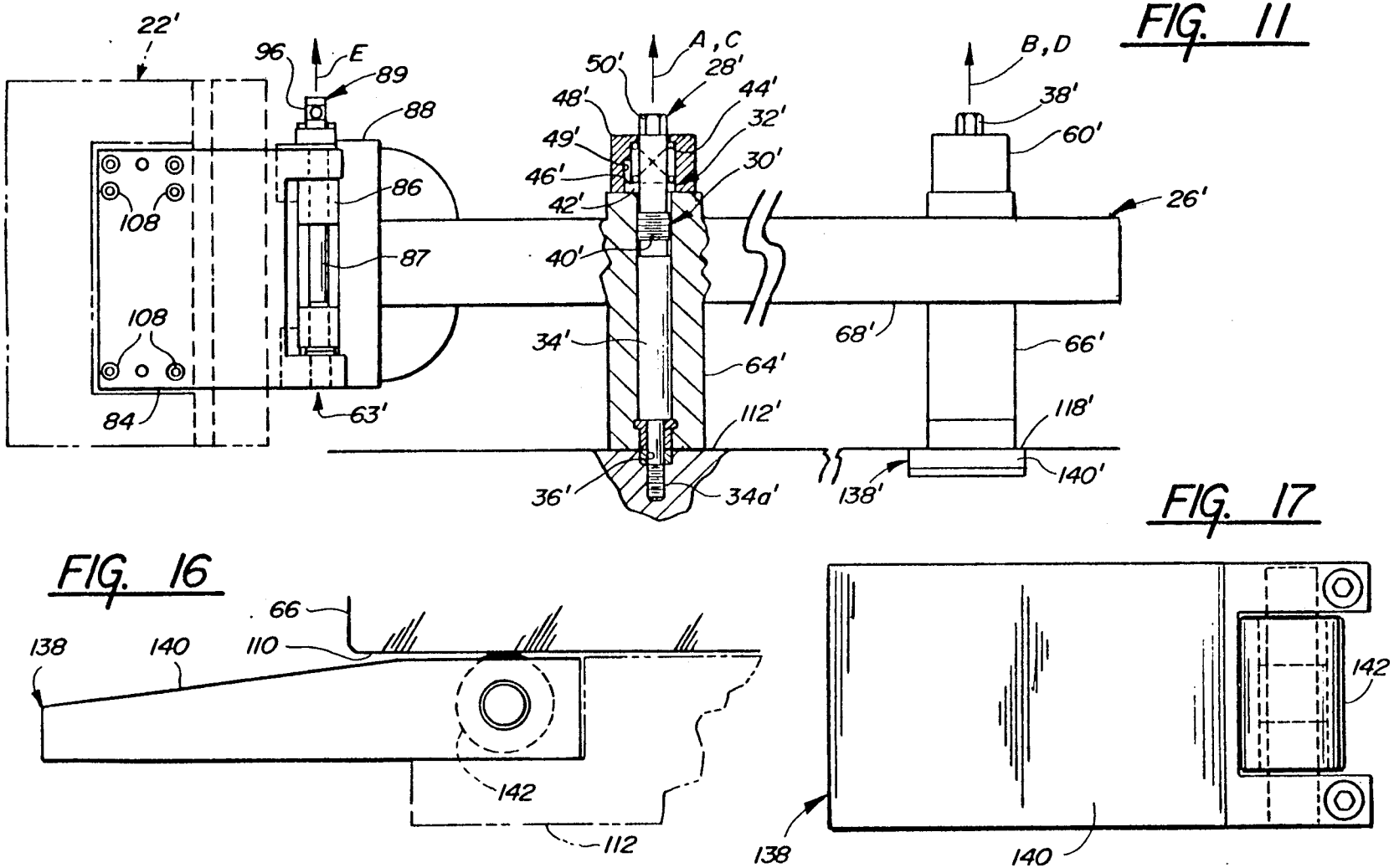
FIG. 11 is a front elevation view of the support means shown in FIG. 10.
FIG. 16 is side elevation view of the deceleration means of the subject invention.
FIG. 17 is a top view of the deceleration means shown in FIG. 16.
Figure 12:
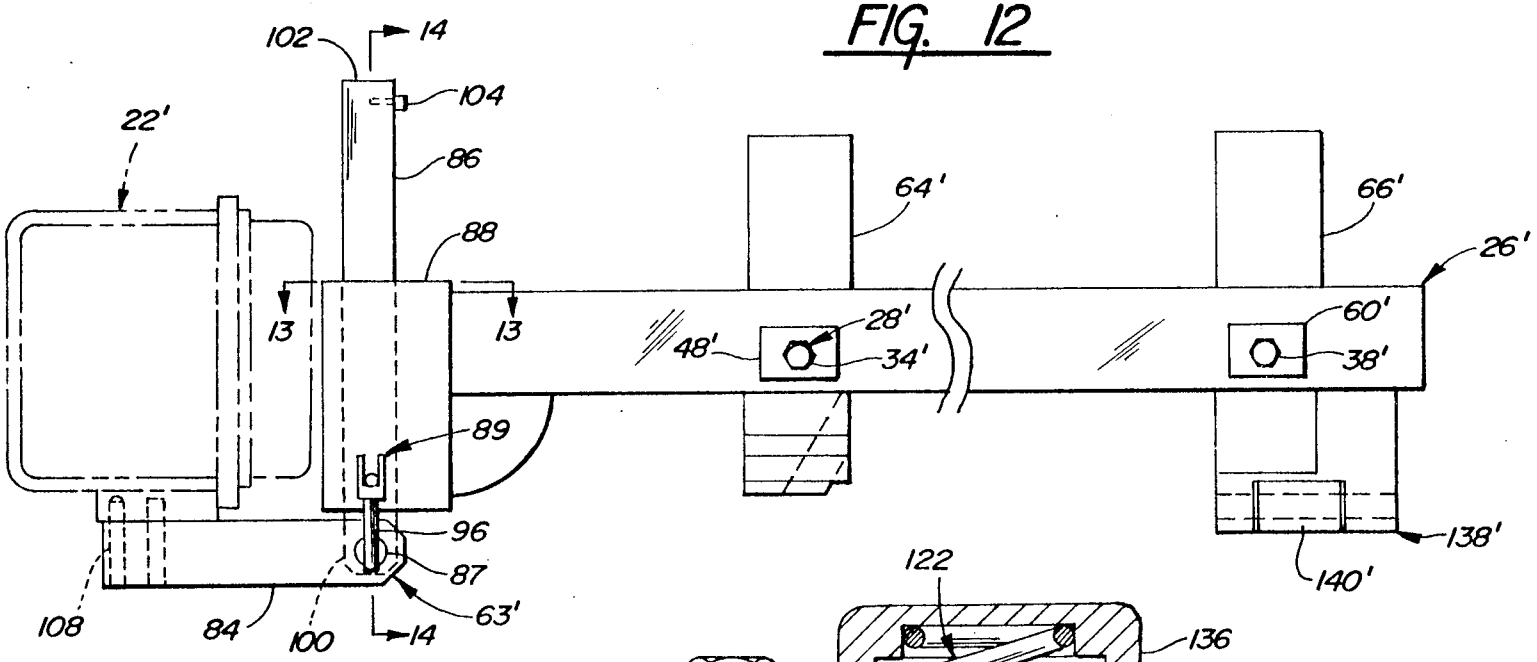
FIG. 12 is a top view of the support means shown in FIG. 11.

Referring now to FIG. 10, movement of the support means 26' from the operative position will be described. The first screw shaft 34' and second screw shaft 38' are first unthreaded from the respective bores 36', 39' of the press 22'. The corresponding first 40' and second 54' locking screws retain the first 34' and second 38' screw shafts in the retracted position. The attached first 64' and second 66' stanchions and the transfer tube 68' are moved laterally of the dies, with the sleeve member 88 sliding along the slide plate 86. When the plunger 90 aligns with the recess 92 in the slide plate 86, the return means 94 automatically inserts the plunger 90 into the recess 92 to prevent further movement of the sleeve member 88 relative to the slide plate 86.

With the slide plate 86 and the sleeve member 88 locked together, the support means 26' begins arcuate movement about the rotary axis E'. Accordingly, the attached slide plate 86, sleeve member 88, transfer tube 68' and stanchions 64', 66' rotate on the hinge member 87, while the mounting late 84 supports the entire assembly 20' on the press 22'. With the support means 26' rotated away from the operative position, access is provided to the die area.

To return the support means 26' to the operative position as shown in FIG. 10, the transfer tube 68' is rotated back toward the dies until both of the first 64' and second 66' stanchions are supported by the press 22'. The key 96 is then rotated causing the camming surface 98 to remove the plunger 90 from the recess 92. This unlocks the sleeve member 88 from the slide plate 86 and allows sliding movement therebetween. The support means 26' is finally adjusted to a desired lateral spacing from the dies and the first 34' and second 38' screw shafts returned to the extended positions secured in their respective bores 36', 39'.

DETAILED DESCRIPTION OF FIGS. 15-17

Figure 15:
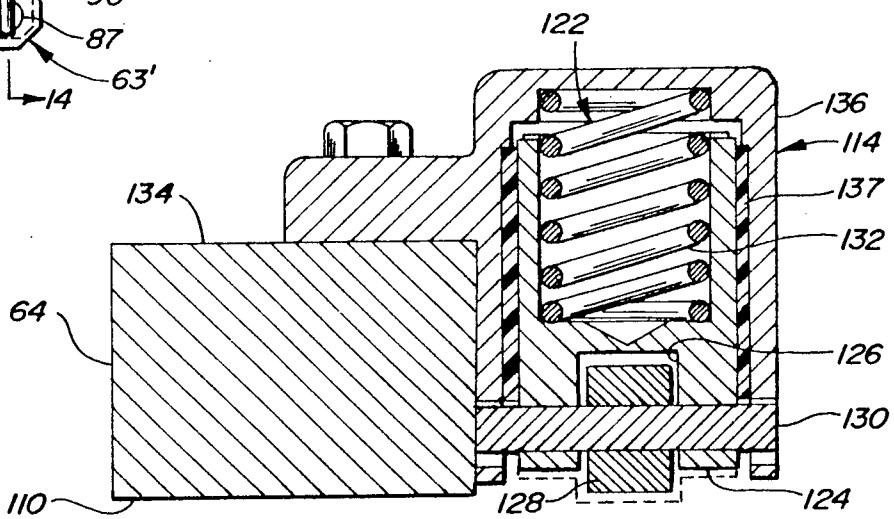
FIG. 15 is a cross-sectional view of the roller means of the subject invention as taken along lines 15—15 of FIG. 4.

The structures illustrated in FIGS. 15-17 are used in connection with either the workpiece transfer apparatus 20 illustrated in FIGS. 1-9 or the alternative workpiece transfer apparatus 20' illustrated in FIGS. 10-14. For convenience, however, the remaining description will reference only the embodiment of FIGS. 1-9.

Referring now to FIGS. 3, 5, 6 and 15, the first stanchion 64 includes a lower surface 110 adapted to engage a bolster 112 of the press 22. The support means 26 includes a first roller means, generally indicated at 114, which extends below the lower surface 110 of the first stanchion 64 for rollably engaging the bolster 112 of the press 22 to facilitate movement of the support means 26 from the operative position. Likewise, the second stanchion 66 includes a lower surface 116 adapted to engage another bolster 118 of the press 22. A second roller means, generally indicated at 120, extends below the lower surface 116 of the second stanchion 64 for rollably engaging the bolster 118 of the press 22 to facilitate movement of the support means 26 from the operative position.

The first 114 and second 120 roller means include a retraction means, generally indicated at 122, for automatically retracting the first 114 and second 120 roller means above the respective lower surfaces 110, 116 upon movement of the fastener means 28 toward the retracted position as shown in FIGS. 5 and 15. The retraction means 122 then automatically reextends the first 114 and second 120 roller means below their respective lower surfaces 110, 116 upon movement of the fastener means 28 toward the extended position, as shown in FIG. 6 and in phantom in FIG. 15.

The first 114 and second 120 roller means each include a fork member 124 defining a channel 126. An annular wheel 128 is disposed in the channel 126, with an axel 130 interconnecting the fork member 124 and wheel 128. The axel 130 is disposed in a vertically elongated slot of the fork member 124 for establishing a limited vertical travel guide for the wheel 128.

The retraction means 122 includes a spring 132 which is contiguous the fork member 124 opposite the channel 126. The spring 130 urges the fork member 124, the axel 130 and the wheel 128 downwardly below the lower surface 110, 116 of the respective first 64 and second 66 stanchions.

Figure 1:
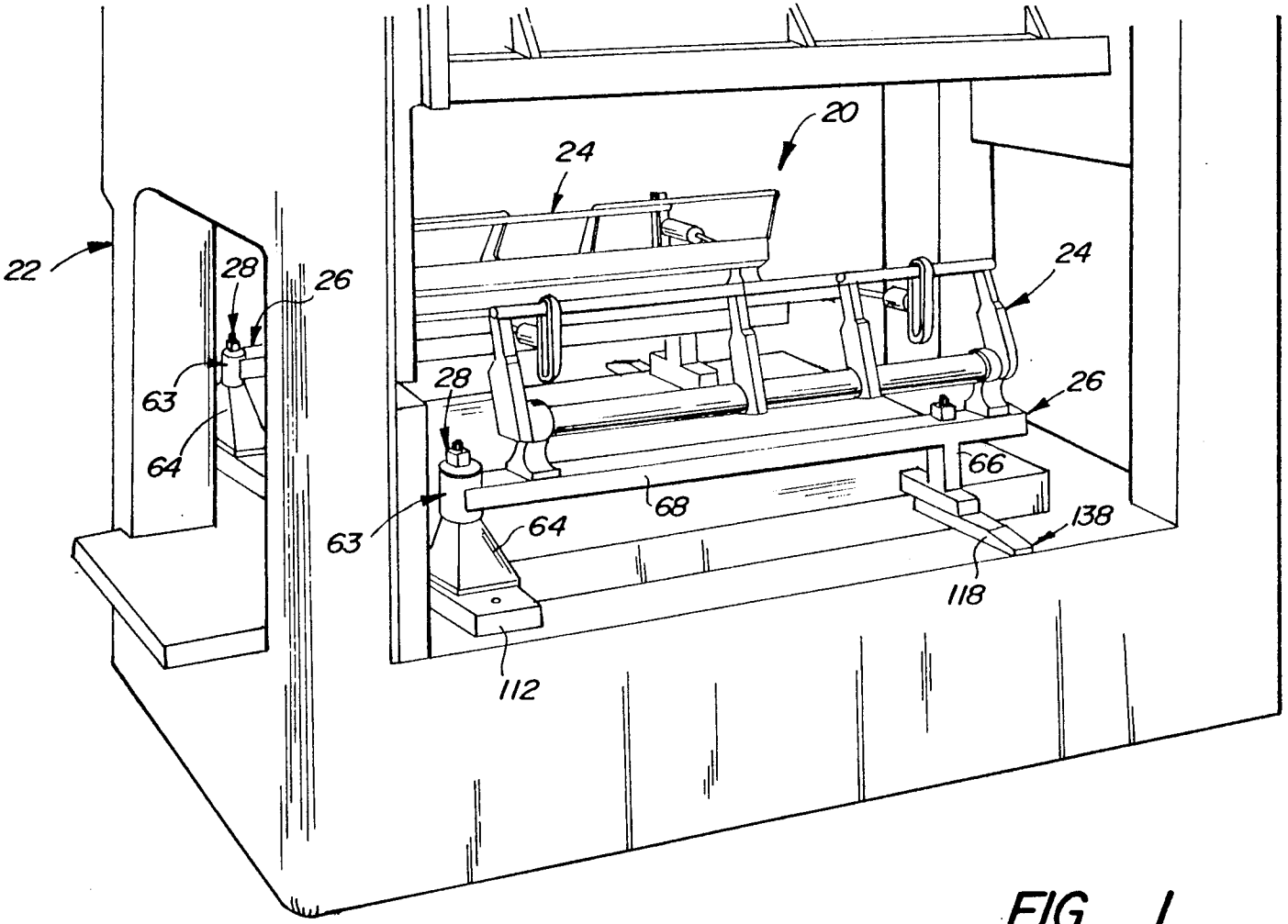
FIG. 1 is a perspective view of the subject invention disposed for operation in a stamping press.
Figure 2:
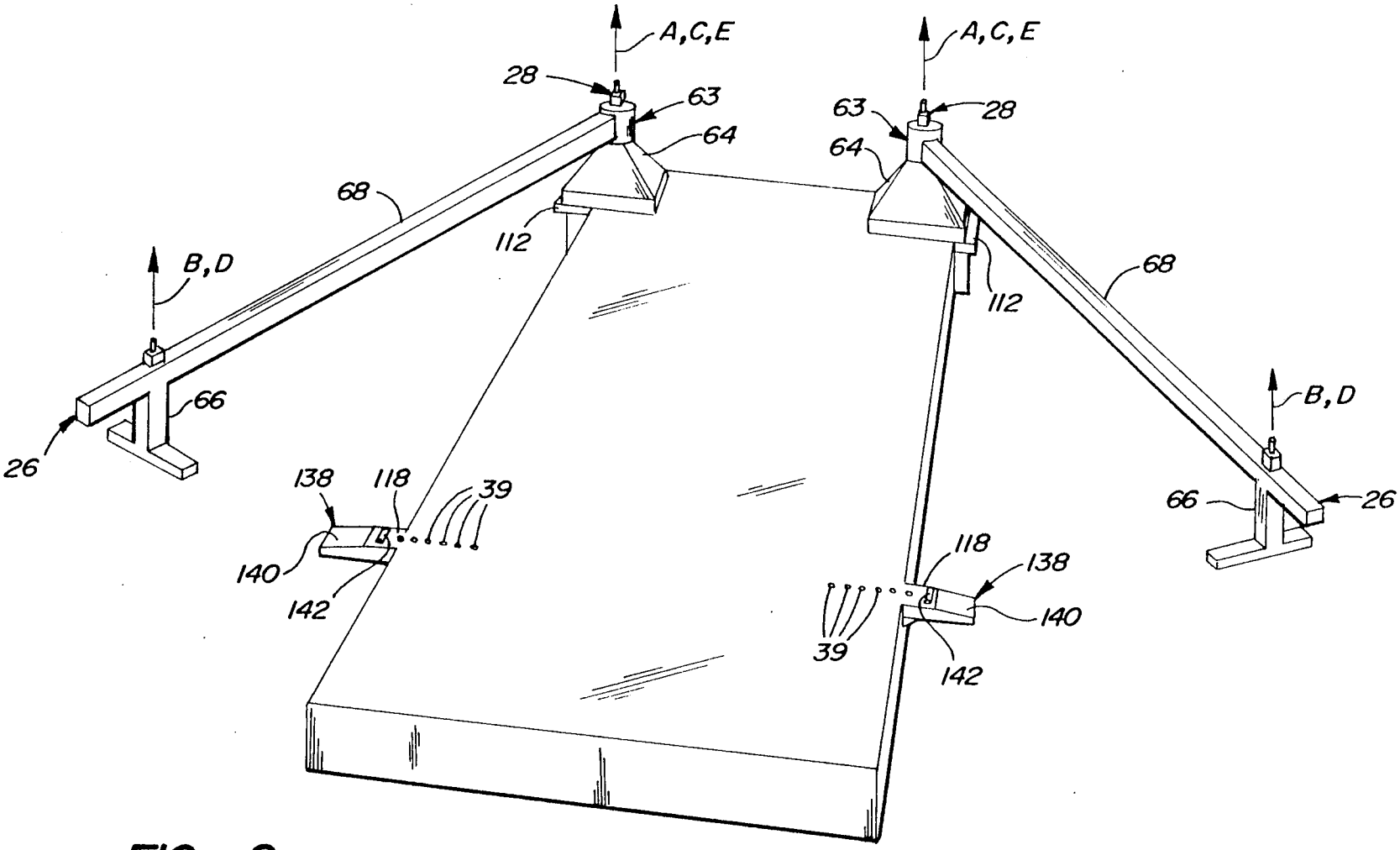
FIG. 2 is a simplified perspective view of the subject invention showing the support means rotated from the operative position.

As shown in FIG. 2, each of the bolsters 112, 118 include a plurality of the bores 36, 39 spaced apart to receive the fastener means 28. These multiple bores 36, 39 allow for lateral adjustment of the entire support means 26 and indexing means 24 relative to the dies.

When the fastener means 28 is retracted and the first 114 and second 120 roller means extend downwardly past the respective lower surfaces 110, 116, the support means 26 will be freely rollable along the bolsters 112, 118 to facilitate aligning the first 34 and second 38 screw shafts with the desired bores 36, 39, respectively.

Figure 4:
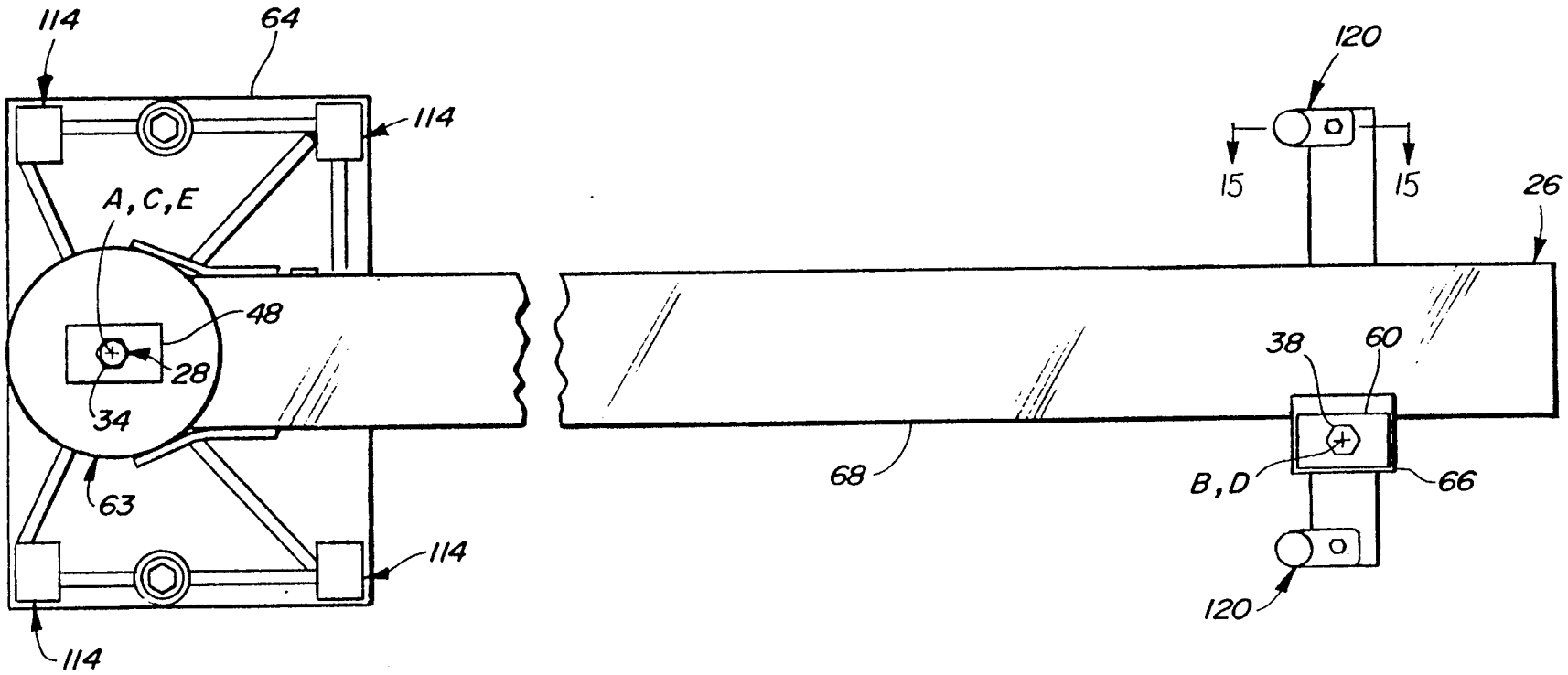
FIG. 4 is a top view of the support means shown in FIG. 3.

As best shown in FIGS. 4 and 15, the first stanchion 64 includes an upper surface 134 spaced generally parallel to the associated lower surface 110. First roller means 114 includes a housing 136 which is fixedly disposed on the upper surface 134 of the first stanchion 64. The housing 136 supports one end of the spring 132 and also provides a guide in which the fork member 124 is linearly reciprocated. A thin tubular bushing 137 is disposed between the fork member 124 and the housing 136.

Referring now to FIGS. 16 and 17, a deceleration means, generally indicated at 138, is provided for gradually loading and unloading bending moments on the rotation means 63 as the support means 26 is moved to and from the operative position. More particularly, the deceleration means 138 comprises a sloped ramp 140 which is disposed adjacent the lower surface 116 of the second stanchion 66 and adapted to be fixed to the bolster 118 of the press 22.

A barrel 142 is supported for rotation about a longitudinal axis which is perpendicular to the second screw axis B. The barrel 142 has a portion thereof disposed above the lower surface 116 of the second stanchion 66 when the support means 26 is in the operational position. As the support means 26 is moved away from the operational position, the lower surface 116 of the second stanchion 66 engages and is forced slightly upwardly by the barrel 142. The barrel 142 provides a free rolling surface which facilitates movement of the second stanchion 66 thereover as shown in FIG. 16. The sloped ramp 140 extends downwardly from the barrel 142 so that as the lower surface 116 of the second stanchion 66 moves off of the barrel 142, the lower surface 116 will engage and slide downwardly along the ramp 140. Before reaching the end of the ramp 140, the lower surface 116 of the stanchion 66 will separate and move outwardly from the ramp 140 as the full load of the support means 26 is borne by the rotation means 63.

In reverse manner, as the support means 26 is moved toward the operative position, the lower surface 116 of the second stanchion 66 first engages the ramp 140 and moves upwardly therealong until engaging the barrel 142. Then, the lower surface 116 smoothly rolls over the barrel 142 and toward the operative position, as shown in FIG. 16, where the second roller means 120 aides movement of the support means 26 toward the operational position.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A workpiece transfer apparatus (20) for a progressive die type stamping press (22), said apparatus (20) comprising: indexing means (24) for moving workpieces between adjacent progressive dies; support means (26) having an operative position adjacent the press (22) for supporting said indexing means (24); fastener means (28) disposed for movement with the force of gravity to an extended position engaged with said support means (26) for fastening said support means (26) in said operative position and against the force of gravity to a retracted position disengaged from said support means (26) for allowing movement of said support means (26) out of said operative position; and characterized by retainer means (30) comprising a rigid member for mechanically retaining said fastener means (28) in said retracted position against the force of gravity to allow movement of said support means (26) from said operative position, said retainer means (30) including automatic locking means (32) for engaging said fastener means (28) after said fastener means (28) has moved a predetermined distance from said extended position and before being disengaged from said support means (26) to automatically lock said fastener means (28) in said retracted position.

2. An apparatus (20) as set forth in claim 1 further characterized by said fastener means (28) including a first screw shaft (34) extending along a first screw axis (A) and having a predetermined screw threaded pitch for operatively engaging a threaded bore (36) of the press (22).

3. An apparatus (20) as set forth in claim 2 further characterized by said automatic locking means (32) including a first locking screw (40) associated with said first screw shaft (34) and rotatable about a first lock axis (C) in response to rotation of said first screw shaft (34) about said first screw axis (A).

4. An apparatus (20) as set forth in claim 3 further characterized by said first locking screw (40) having a screw thread pitch equivalent to said screw thread pitch of said first screw shaft (34).

5. An apparatus (20) as set forth in claim 4 further characterized by said automatic locking means (32) including a first locking nut (42) spaced axially from said first locking screw (40) for operatively engaging said first locking screw (40) in response to movement of said first screw shaft (34) from said extended position to said retracted position.

6. An apparatus (20) as set forth in claim 5 further characterized by said automatic locking means (32) including a first biasing means (44) for biasing said first locking nut (42) toward said first locking screw (40).

7. An apparatus (20) as set forth in claim 6 further characterized by said first locking screw (40) being integral with said first screw shaft (34) and said first screw axis (A) and said first lock axis (C) being coaxial.

8. An apparatus (20) as set forth in claim 7 further characterized by said first locking nut (42) including anti-rotation means (46) for preventing rotation of said first locking nut (42) while allowing movement thereof along said first lock axis (C).

9. An apparatus (20) as set forth in claim 8 further characterized by said automatic locking means (32) including a first cover member (48) surrounding said first locking nut (42) and said first biasing means (44), with said anti-rotation means (46) being disposed between said first locking nut (42) and said first cover member (48).

10. An apparatus (20) as set forth in claim 9 further characterized by said first screw shaft (34) including a tool adapter portion (50) extending through said first cover member (48) for receiving a tool to rotate said first screw shaft (34) about said first screw axis (A).

11. An apparatus (20) as set forth in claim 8 further characterized by said support means (26) including rotation means (63) for fixed attachment relative to the press (22) for rotating said indexing means (24) about a rotary axis (E) to and from said operative position.

12. An apparatus (20) as set forth in claim 11 further characterized by said rotary axis (E) and said first screw axis (A) being parallel.

13. An apparatus (20) as set forth in claim 12 further characterized by said fastener means (28) including a second screw shaft (38) spaced from said first screw shaft (34) and having a second screw axis (B) parallel to said first screw axis (A) and a predetermined screw thread pitch.

14. An apparatus (20) as set forth in claim 13 further characterized by said automatic locking means (32) including a second locking screw (54) associated with said second screw shaft (38) and rotatable about a second lock axis (D) in response to rotation of said second screw shaft (38) about said second screw axis (B).

15. An apparatus (20) as set forth in claim 14 further characterized by said second locking screw having a screw thread pitch equivalent to said screw thread pitch of said second screw shaft (38).

16. An apparatus (20) as set forth in claim 15 further characterized by said automatic locking means (32) including a second locking nut (56) spaced axially from said second locking screw (54) and resiliently biased toward said second locking screw (54) for operatively engaging said second locking screw (54) in response to movement of said second screw shaft (38) from said extended position to said retracted position.

17. An apparatus (20) as set forth in claim 16 further characterized by said second locking screw (54) being integral with said second screw shaft (38) and said second screw axis (B) and said second lock axis (D) being coaxial.

18. An apparatus (20) as set forth in claim 17 further characterized by said second locking nut (56) including second anti-rotation means (58) for preventing rotation of said second locking nut (56) while allowing movement thereof along said second lock axis (D).

19. An apparatus (20) as set forth in claim 18 further characterized by said automatic locking means including a second cover member (60) surrounding said second locking nut (56), with said second anti-rotation means (58) being disposed between said second locking nut (56) and said second cover member (60).

20. An apparatus (20) as set forth in claim 19 further characterized by said second screw shaft (38) including a tool adapter portion (62) extending through said second cover member (60) for receiving a tool to rotate said second screw shaft (38) about said second screw axis (B).

21. An apparatus (20) as set forth in claim 18 further characterized by said first screw axis (A) and said rotary axis (E) being coaxial.

22. An apparatus (20) as set forth in claim 21 further characterized by said support means (26) including a first stanchion (64) surrounding said first screw shaft (34) and interconnecting said rotation means (63) and said first screw shaft (34), and a second stanchion (66) surrounding said second screw shaft (38).

23. An apparatus (20) as set forth in claim 22 further characterized by said support means (26) including an elongated transfer tube (68) adjacent said indexing means (24) and extending perpendicularly of said first (A) and second (B) screw axes to interconnect said second stanchion (66) and said rotation means (63).

24. An apparatus (20) as set forth in claim 23 further characterized by said rotation means (63) including an upper roller bearing (70) disposed annularly about said first screw shaft (34) and between said first stanchion (64) and said transfer tube (68) and a lower roller bearing (72) coaxially spaced from said upper roller bearing (70) between said first stanchion (64) and said transfer tube (68).

25. An apparatus (20) as set forth in claim 24 further characterized by including protector means (76) disposed over said rotation means (63) for protecting said rotation means (63) from dirt contamination.

26. An apparatus (20) as set forth in claim 25 further characterized by said protector means (76) including an annular wall (78) disposed circumferentially about said upper roller bearing (70) and a disk member (80) extending radially outwardly of said first screw shaft (34), said disk member (80) having an annular groove (82) matingly receiving said annular wall (78) to form an annular labyrinth.

27. An apparatus (20') as set forth in claim 18 further characterized by said first screw axis (A') and said rotary axis (E') being laterally spaced apart.

28. An apparatus (20') as set forth in claim 27 further characterized by said support means (26') including a first stanchion (64') surrounding said first screw shaft (34') and a second stanchion (66') surrounding said second screw shaft (38').

29. An apparatus (20') as set forth in claim 28 further characterized by said support means (26') including an elongated transfer tube (68') interconnecting said first stanchion (64') and said second stanchion (66') with said rotation means (63') and extending perpendicularly of said first screw axis (A') and said second screw axis (B').

30. An apparatus (20') as set forth in claim 29 further characterized by said rotation means (63') including a mounting plate (84) for fixed attachment to the press (22') and an elongated slide plate (86) pivotally connected to said mounting plate (84) about said rotary axis (E').

31. An apparatus (20') as set forth in claim 30 further characterized by said support means (26') including a sleeve member (88) disposed around said slide plate (86) for relative sliding movement therebetween to allow lateral movement of said support means (26') relative to said rotary axis (E').

32. An apparatus (20') as set forth in claim 31 further characterized by including securing means (89) for securing said sleeve member (88) to said slide plate (86) to prevent relative sliding movement therebetween.

33. An apparatus (20') as set forth in claim 32 wherein said slide plate (86) extends between a pivotal end (100) adjacent said rotary axis (E') and a distal end (102), further characterized by said slide plate (86) including stop means (104) adjacent said distal end (102) for limiting movement of said sleeve member (88) therepast.

34. An apparatus (20') as set forth in claim 33 further characterized by said securing means (89) including a plunger (90) extending through said sleeve member (88) and adapted to engage a recess (92) in said slide plate (86).

35. An apparatus (20') as set forth in claim 34 further characterized by said securing means (89) including return means (94) associated with said plunger (90) for biasing said plunger (90) toward said recess (92) in slide plate (86).

36. An apparatus (20') as set forth in claim 35 further characterized by said securing means (89) including a key (96) pivotally attached to said plunger (90) and having a camming surface (98) adapted to urge said plunger (90) against said return means (94) upon rotation of said key (96).

37. An apparatus (20') as set forth in claim 36 further characterized by said rotation means (63') including a cylindrical hinge member (87) extending along said rotary axis (E') and interconnecting said slide plate (86) and said mounting plate (84).

38. An apparatus (20') as set forth in claim 37 further characterized by said slide plate (86) having a generally rectangular cross section as taken through a plane passing parallel to said rotary axis (E').

39. An apparatus (20') as set forth in claim 38 further characterized by said mounting plate (84) including a plurality of bolts (108) extending therethrough for attachment to the press (22).

40. An apparatus (20) as set forth in either of claims 23 or 32 wherein said first stanchion (64) includes a lower surface (110) adapted to engage a bolster (112) of the press (22), further characterized by said support means (26) including first roller means (114) extending below said lower surface (110) of said first stanchion (64) for rollably engaging the bolster (112) of the press (22) to facilitate movement of said support means (26) from said operative position.

41. An apparatus (20) as set forth in claim 40 wherein said second stanchion (66) includes a lower surface (116) adapted to engage a bolster (118) of the press (22), further characterized by said support means (26) including second roller means (120) extending below said lower surface (116) of said second stanchion (66) for rollably engaging the bolster (116) of the press (22) to facilitate movement of said support means (26) from said operative position.

42. An apparatus (20) as set forth in claim 41 further characterized by said first (114) and second (120) roller means including retraction means (122) for automatically retracting said first (114) and second (120) roller means above said respective lower surfaces (110, 116) upon movement of said fastener means (28) toward said retracted position and automatically reextending said first (114) and second (120) roller means below said respective lower surfaces (110, 116) upon movement of said fastener means (28) toward said extended position.

43. An apparatus (20) as set forth in claim 42 further characterized by including deceleration means (138) for gradually loading and unloading bending moments on said rotation means (63) as said support means (26) is moved to and from said operative position.

44. An apparatus (20) as set forth in claim 43 further characterized by said deceleration means (138) including a sloped ramp (140) disposed adjacent said second stanchion (66) and adapted to be fixed to the bolster (118) of the press (22).

45. An apparatus (20) as set forth in claim 44 further characterized by said deceleration means (138) including a barrel (142) supported for rotation about a longitudinal axis perpendicular to said second screw axis (B) and having a portion thereof disposed above said lower surface (116) of said second stanchion (66) when said support means (26) is in said operative position.

46. An apparatus (20) as set forth in claim 45 further characterized by said first (114) and second (120) roller means including a fork member (124) defining a channel (126), an annular wheel (128) having a central axis and disposed in said channel (126), and an axle (130) rotatably interconnecting said fork member (124) and said wheel (128).

47. An apparatus (20) as set forth in claim 46 further characterized by said retraction means (122) including a spring (132) contiguous with said fork member (124) for urging said wheel (128) below said lower surface (110, 116) of said respective first (64) and second (66) stanchions.

48. An apparatus (20) as set forth in claim 47 wherein said first stanchion (64) includes an upper surface (134) spaced generally parallel from said lower surface (110) thereof, further characterized by said first roller means (140) including a housing (136) fixedly disposed on said upper surface (134) of said first stanchion (64) for covering said first roller means (140).

49. A support structure for a workpiece transfer apparatus (20) for a progressive die type stamping press (22), said support structure comprising: a first stanchion (64); a first screw shaft (34) passing vertically through said first stanchion (64); a second stanchion (66); a second screw shaft (38) passing vertically through said second stanchion (66); a transfer tube (68) extending horizontally and interconnecting said first stanchion (64) and said second stanchion (66); rotation means (63) for rotatably supporting said transfer tube (68) about a vertical axis (E); a first locking screw (40) integral with said first screw shaft (34); a first locking nut (42) disposed around said first screw shaft (34) and operatively engagable with said first locking screw (40); a second locking screw (54) integral with said second screw shaft (38); a second locking nut (56) disposed around said second screw shaft (38) and operatively engagable with said second locking screw (54).

* * * * *